US008794802B2

(12) United States Patent
Wu et al.

(10) Patent No.: US 8,794,802 B2
(45) Date of Patent: Aug. 5, 2014

(54) WATERPROOF APPARATUS FOR OUTDOOR LIGHTING WITH ELECTRONIC DEVICE SEALED IN CAVITY OF AN ALUMINUM EXTRUSION

(75) Inventors: Hsiang-Chen Wu, Taoyuan Hsien (TW); Chun-Wei Liang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/609,761

(22) Filed: Sep. 11, 2012

(65) Prior Publication Data

US 2013/0088881 A1 Apr. 11, 2013

(30) Foreign Application Priority Data

Oct. 11, 2011 (TW) ..... 100136623 A

(51) Int. Cl.

| | |
|---|---|
| ***F21V 31/00*** | (2006.01) |
| ***F21V 29/00*** | (2006.01) |
| ***F21V 15/01*** | (2006.01) |
| *F21W 131/103* | (2006.01) |

(52) U.S. Cl.

CPC ..... *F21V 31/005* (2013.01); *F21V 15/011* (2013.01); *F21V 15/013* (2013.01); *F21W 2131/103* (2013.01)

USPC ..... 362/362; 362/373; 362/431

(58) Field of Classification Search

CPC ..... F21V 31/00; F21V 31/005; F21V 15/01; F21V 15/011; F21V 15/013; F21W 2131/10; F21W 2131/103

USPC ..... 362/267, 249.02, 294, 373, 431, 362

See application file for complete search history.

(56) References Cited

U.S. PATENT DOCUMENTS

| | | | | |
|---|---|---|---|---|
| 5,065,291 | A * | 11/1991 | Frost et al. | 362/183 |
| 6,217,203 | B1 * | 4/2001 | Rogers et al. | 362/548 |
| 2009/0262542 | A1 * | 10/2009 | Li et al. | 362/373 |
| 2010/0271822 | A1 * | 10/2010 | Luo et al. | 362/249.02 |
| 2011/0128746 | A1 * | 6/2011 | Zheng | 362/373 |
| 2011/0210676 | A1 * | 9/2011 | Beghelli | 315/185 R |
| 2012/0087118 | A1 * | 4/2012 | Bailey et al. | 362/235 |

* cited by examiner

*Primary Examiner* — Nimeshkumar Patel
*Assistant Examiner* — Steven Horikoshi
(74) *Attorney, Agent, or Firm* — Muncy, Geissler, Olds & Lowe, P.C.

(57) ABSTRACT

A waterproof apparatus includes a housing, two first covers, an electronic device and two first waterproof elements. The housing is manufactured by aluminum extrusion and configured with a cavity. The first covers are disposed in the cavity. The electronic device is disposed between the first covers in the cavity. The first waterproof elements are located at one side of one first cover, which is opposite to the other first cover.

20 Claims, 4 Drawing Sheets

WATERPROOF APPARATUS FOR OUTDOOR LIGHTING WITH ELECTRONIC DEVICE SEALED IN CAVITY OF AN ALUMINUM EXTRUSION

CROSS REFERENCE TO RELATED APPLICATIONS

This Non-provisional application claims priority under 35 U.S.C. §119(a) on Patent Application No(s). 100136623 filed in Taiwan, Republic of China on Oct. 11, 2011, the entire contents of which are hereby incorporated by reference.

BACKGROUND OF THE INVENTION

1. Field of Invention

The invention relates to a waterproof apparatus and in particular to a waterproof apparatus for outdoor lighting.

2. Related Art

The outdoor lightings such as street lights, car lamps and etc., constantly receive frequent and dramatic changes of temperature and pressure from the outside environment. The changing temperature, dust, dirt and moisture drastically affect the life-span of the outdoor lightings. Thus, waterproof function of lighting appears very important.

Specifically speaking, the temperature of the lighting housing would dramatically drop when it rains, and this will lead to inner pressure decrease of the lighting. Thus, moisture and air would get into the lighting by passing through the leak of the housing more easily. Moreover, moisture would condense to water drops, attach onto the inner wall of the housing and badly affect the performance of the lighting.

One of the conventional waterproof methods is to stuff up the crack of the housing with a sealant. However, when the housing is assembled with multiple parts, the locking force differences, caused when assembling different parts, may lead to fracture at the connecting interfaces. In addition, the adhesive of the sealant may crack due to tolerance, and further become invalid of waterproof and dust-proof.

Besides, the constant temperature changes of the environment can apply various stresses to the sealant, thereby causing the deterioration and leak of the sealant. The deteriorated sealant is unable to stop the moisture, and more seriously, it may allow water and dirt to get into the lighting via the crack.

Therefore, it is an important subject to provide a waterproof apparatus which can be used under humidity and adverse environment for a long time, possesses great performance on waterproof and dust-proof, and is of long life-span and low cost.

SUMMARY OF THE INVENTION

In view of the foregoing, an object of this invention is to provide a waterproof apparatus, which can be used under humidity and adverse environment for a long time, possesses great performance on waterproof and dust-proof, and is of long life-span and low cost.

To achieve the above object, this invention discloses a waterproof apparatus including a housing, two first covers, an electronic device and two first waterproof elements. The housing is manufactured by aluminum extrusion and configured with a cavity. The first covers are disposed in the cavity. The electronic device is disposed between the first covers and accommodated in the cavity. The first waterproof elements are located at one side of one first cover, which is opposite to the other first cover.

In one embodiment, the waterproof apparatus further includes a second cover and a second waterproof element. The second cover is disposed on the housing, and the second waterproof element is disposed on one side of the second cover opposite to the cavity. The first covers, the first waterproof elements, the housing, the second cover and the second waterproof element together form an air-tight space to accommodate the electronic device. The first covers and the first waterproof elements seal two first openings of the cavity. After the electronic device is disposed into the air-tight space through a second opening of the cavity, the second cover and the second waterproof element seal the second opening.

In one embodiment, the first covers, the first waterproof elements and the housing together form an air-tight space to accommodate the electronic device.

In one embodiment, the waterproof apparatus further includes a carrier plate, and the electronic device is disposed on the carrier plate. After the carrier plate is accommodated into the air-tight space through one of the first openings, the first covers and the first waterproof elements seal the two first openings of the housing. The carrier plate is accommodated into the air-tight space and connected to the housing by locking, screwing, adhering or their combinations.

In one embodiment, the first waterproof element or the second waterproof element has an annular or plate shape.

In one embodiment, a concave-convex structure is configured on a portion of the first waterproof element or the second waterproof element contacting with the housing.

In one embodiment, the first cover or the second cover is connected to the housing by locking, screwing, adhering, pivoting or their combinations.

In one embodiment, the housing further includes a heat dissipation part, which is integrally formed with the housing.

As mentioned above, the waterproof apparatus of this invention achieve the objective of waterproof in three dimensions by using aluminum extruded housing, the first covers and the first waterproof elements, or by using the aluminum extruded housing, the first covers, the first waterproof elements, the second cover and the second waterproof element. Comparing to the conventional device, since the first covers and the first waterproof elements are accommodated in the cavity of the housing, it can not only avoid the sun beam to reduce cracking and breaking of the first waterproof elements, but also make the first waterproof elements more closely connected to the housing. Thus, the tolerance caused by connection of the housing can not influence the waterproof and dust-proof performance, thereby further prolonging the life-span and enhancing the waterproof level of the waterproof structure as well as the electronic products such as the lighting. Besides, the assembling procedure of this invention is simple and easy. The electronic devices can be disposed into the waterproof apparatus in different ways under different conformations. The first embodiment in which the electronic devices are disposed through the first opening can further decrease the waterproof elements and the covers applied in the waterproof apparatus, thereby reducing the production cost.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
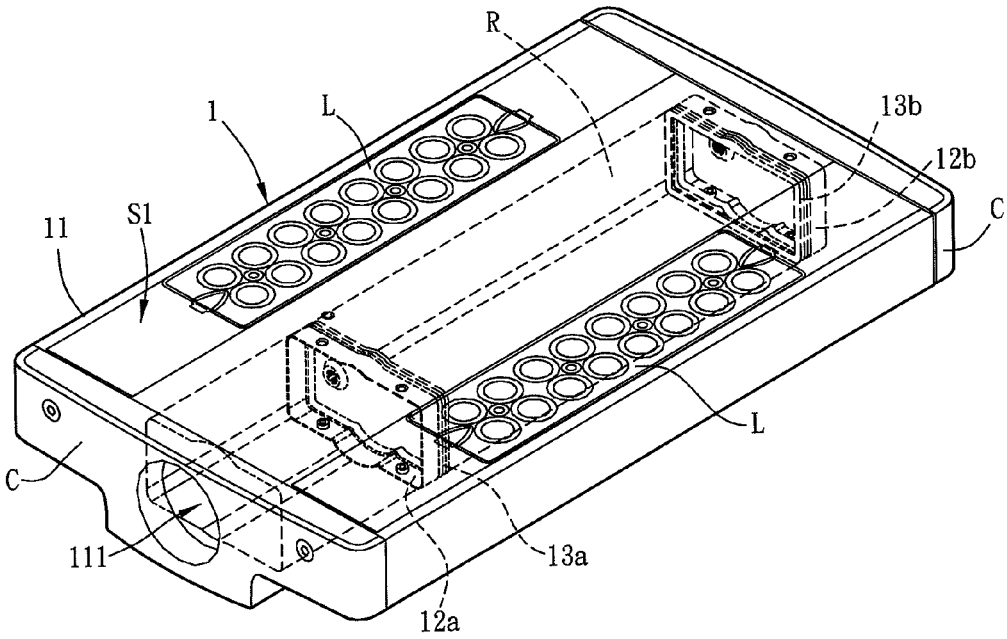
FIG. 1A is a perspective view showing a waterproof apparatus of a first embodiment according to the preferred embodiment of the present invention.
Figure 1B:
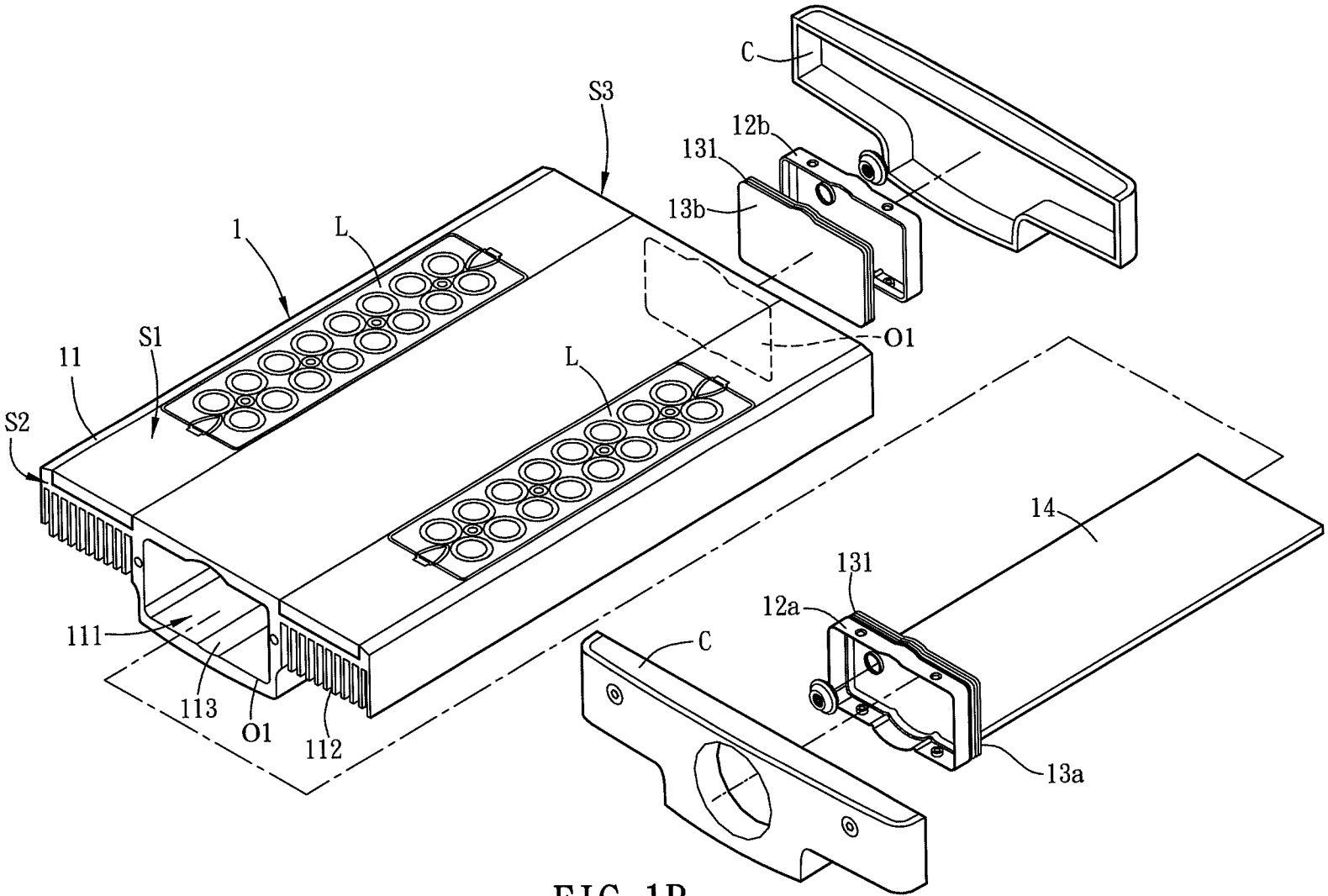
FIG. 1B is an exploded view of the waterproof apparatus of the first embodiment according to the preferred embodiment of the present invention.

FIG. 1A is a perspective view showing a waterproof apparatus 1 of a first embodiment according to the preferred embodiment of the present invention, and FIG. 1B is an exploded view of the waterproof apparatus 1. As shown in FIG. 1A and FIG. 1B, the waterproof apparatus 1 includes a housing 11, two first covers 12*a* and 12*b*, and two first waterproof elements 13*a* and 13*b*. In this embodiment, the waterproof apparatus 1 is applied in lighting. Surely, the waterproof apparatus 1 may also be applied to, for example but not limited to, other electronic products with waterproof and dust-proof needs.

The housing 11 can be manufactured by aluminum extrusion and configured with a cavity 111. The aluminum extrusion has the advantages of simple processes and low cost (cheaper molds). Since aluminum extrusion is to press the aluminum material in one dimension, an additional waterproof structure is needed in the other two dimensions to achieve a total waterproof effect. The waterproof structure of the other two dimensions will be further illustrated afterward.

The cavity 111 is an inner chamber of the housing 11, and is configured with two first openings O1 situated on outer surfaces S2 and S3, respectively. When the waterproof apparatus 1 is applied to the lighting, the cavity 111 can be connected to a light stand (not shown), and can accommodate the necessary electronic elements (not shown) such as, for example but not limited to, a transformer or a circuit board for the lighting. Besides, the housing 11 can further include a heat dissipation part 112 to speed up the heat transfer in the lighting. In this case, the heat dissipation part 112 includes several heat dissipating fins as the example. The heat dissipation part 112 can be integrally formed with the housing 11 to further reduce the manufacturing and assembling costs.

The first covers 12*a* and 12*b* are accommodated in the cavity 111 to seal two first openings O1 of the cavity 111. In more detailed, the first covers 12*a* and 12*b* are accommodated inside the cavity 111 and have a distance to the first openings O1. In other words, the first covers 12*a* and 12*b* are not located on the cross-section of the housing 11, but are positioned at, for example but not limited to, a quarter part of the cavity 111. The electronic element (not shown) is accommodated in the cavity 111 and located between two first covers 12*a* and 12*b*. In this case, by the design of the appearances of the first covers 12*a* and 12*b* in cooperated with the grooves 113 on the inner surface of the housing 11, the first covers 12*a* and 12*b* can be precisely pushed into the cavity 111 through the first opening O1. Besides, it is possible to apply some fixing elements on the outer surface S1 of the housing 11 for inwardly locking the first covers 12*a* and 12*b* to the housing 11, thereby fixing the housing 11 in the cavity 111. To be noted, in this invention, the connecting method of the cavity 111 and the first covers 12*a* and 12*b* is not limited, and can be locking, screwing, adhering, pivoting or their combinations. Besides, one non-solidifying glue can be applied when the first covers 12*a* and 12*b* are accommodated into the cavity 111 so as to not only strengthen the waterproof ability but also reinforce anti-vibrate effect.

The first waterproof element 13*a* is located at one side of the first cover 12*a*, which is opposite to the first cover 12*b*, while the other first waterproof element 13*b* is located at one side of the first cover 12*b*, which is opposite to the first cover 12*a*. In other words, the elements accommodated in the cavity 111 are the first opening O1, the first cover 12*a*, the first waterproof element 13*a*, the electronic element(s), the first waterproof element 13*b*, the first cover 12*b* and the other first opening O1 in a row. Specifically speaking, the first waterproof elements 13*a* and 13*b* are used to seal up the crack between the housing 11 and the first covers 12*a* and 12*b*, and can be made of rubber for example. The first waterproof element 13*a* and 13*b* can have an annular or plate shape. The annular first waterproof elements 13*a* and 13*b* are fit and seal up the crack between the housing 11 and the first covers 12*a* and 12*b*. The plate-shaped first waterproof elements 13*a* and 13*b* can provide a better waterproof and dust-proof effect and a good tolerance resistance. Herein, the first waterproof elements 13*a* and 13*b* are plate-shaped for example, while the second embodiment (see FIGS. 2A and 2B) shows two annular first waterproof elements 23*a* and 23*b*.

To be noted, the purpose to accommodate the first covers 12*a* and 12*b* into the cavity 111 is to match the first waterproof elements 13*a* and 13*b*. Thus, the first waterproof elements 13*a* and 13*b* can be more closely attached to the housing 11, so that lesser sun beam can reach them, thereby prolonging the life-span of the lighting and the waterproof apparatus 1. The principle of raising the sealing effect is as following. According that the first covers 12*a* and 12*b* and the first waterproof elements 13*a* and 13*b* are accommodated in the cavity 111, when assembling the first waterproof elements 13*a* and 13*b* into the cavity 111, the first waterproof elements 13*a* and 13*b* are not only pressed by the first covers 12*a* and 12*b* to deform, but their edges are also deformed due to the close contact with the inner surface of the housing 11. Accordingly, an excellent close effect can be obtained. Besides, the outer edge of the first waterproof elements 13*a* and 13*b* can further possess a concave-convex structure 131 to closely connect to the housing 11. Therefore, the waterproof elements 13*a* and 13*b* with the concave-convex structure 131 receive a smaller friction force, which is easier for assembling, when disposing into the cavity 111. Moreover, this configuration can further improve the waterproof effect and possess the extra shockproof effect.

In the first embodiment, by disposing the first waterproof elements 13*a* and 13*b* and the first covers 12*a* and 12*b* as mentioned above, the first covers 12*a* and 12*b*, the first waterproof elements 13*a* and 13*b*, and the housing 11 can avoid moisture and dust to enter and form an air-tight space R for accommodating the electronic element. This embodiment discloses two methods to install the electronic elements into the air-tight space R, as described in the first and second embodiments. In the first embodiment, as shown in FIGS. 1A and 1B, the waterproof apparatus 1 can further include a carrier plate 14, and the electronic element is fixed on the carrier plate 14. The carrier plate 14 is placed into the air-tight space R through one of the first openings O1, and then the first covers 12*a* and 12*b* and the first waterproof elements 13*a* and 13*b* are provided to seal the two first openings O1 of the cavity 111. After accommodated into the air-tight space R, the carrier plate 14 is connected to the housing 11 by locking, screwing, adhering or their combinations. Herein, the carrier plate 14 is connected to the inner surface of the housing 11 by gluing. In addition, the carrier plate 14 can be locked with long screws from the outer surfaces S2 and S3 of housing 11 after being positioned into the cavity 111. Moreover, the carrier plate 14 and the first covers 12*a* and 12*b* can be integrated formed as one piece.

Figure 2A:
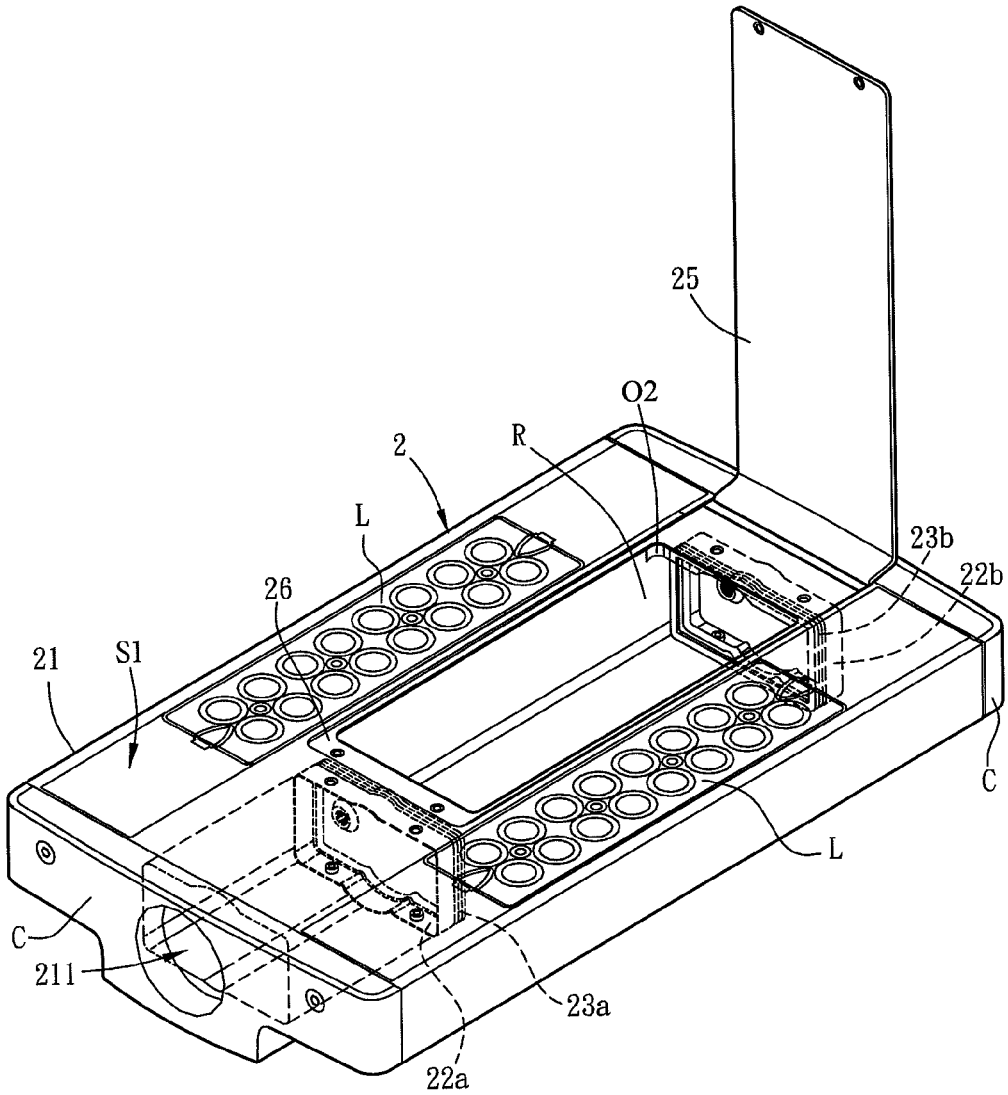
FIG. 2A is a perspective view showing a waterproof apparatus of a second embodiment according to the preferred embodiment of the present invention.
Figure 2B:
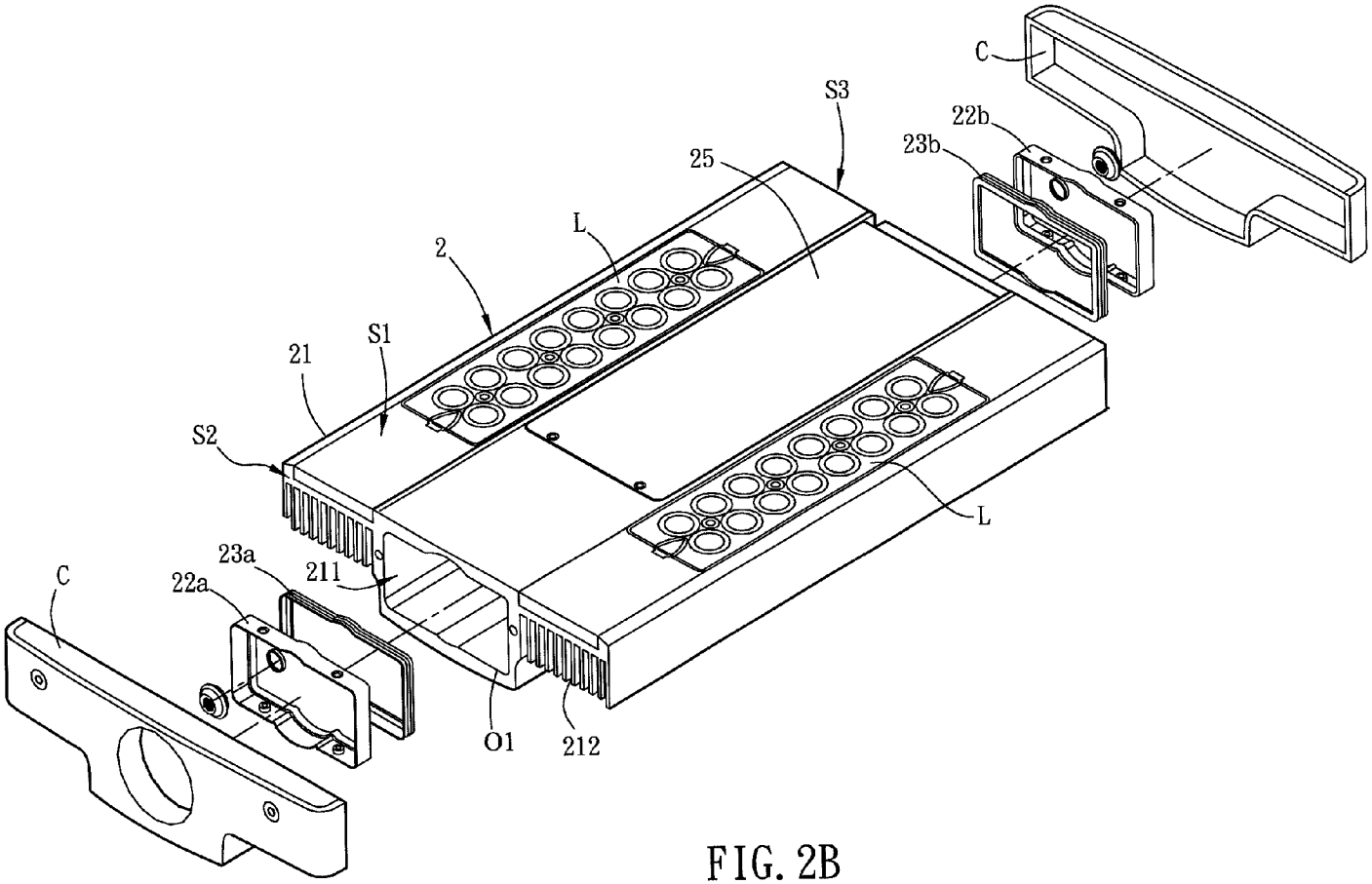
FIG. 2B is an exploded view of the waterproof apparatus of the second embodiment according to the preferred embodiment of the present invention.

FIG. 2A is a perspective view showing a waterproof apparatus 2 of a second embodiment according to the preferred embodiment of the present invention, and FIG. 2B is an exploded view of the waterproof apparatus 2. Referring to FIGS. 2A and 2B, the waterproof apparatus 2 of the second embodiment has similar structure as the waterproof apparatus 1 of the first embodiment and further includes a second cover 25 and a second waterproof element 26. In addition, an outer surface S1 of a housing 21 further includes a second opening O2. The second cover 25 is disposed on the outer surface S1 of the housing 21. The second waterproof element 26 is disposed at one side of the second cover 25 which is opposite to a cavity 211 to seal the second opening O2. Moreover, two first covers 22*a* and 22*b* are accommodated in the cavity 211. In this embodiment, the two first covers 22*a* and 22*b* and two first waterproof elements 23*a* and 23*b* are also configured to seal two first openings O1 of the cavity 211. Briefly speaking, in this embodiment, two first covers 22*a* and 22*b*, two first waterproof elements 23*a* and 23*b*, the housing 21, the second cover 25 and the second waterproof element 26 together form an air-tight space R to accommodate the electronic element (not shown).

The second waterproof element 26 can have some aspects the same as the first waterproof elements 13*a* and 13*b* in the first embodiment. Though the first covers 22*a* and 22*b* and the second cover 25 are disposed at different positions, they are also connected with the housing 21 by locking, screwing, adhering, even pivoting or their combinations. The difference between the first and second embodiments is the way for installing the electronic element into the air-tight space R. In this embodiment, the electronic element (not shown) is put into the air-tight space R through the second opening O2. Specifically speaking, the second cover 25 is pivoted to the housing 21. During the assembling process, it is necessary to open the second cover 25 and then put the electronic element into the cavity 211 through the second opening O2. After that, the second waterproof element 26 is disposed at the second opening O2, and finally, the second cover 25 is provided to lock up the second opening O2 with screws, thereby completing the sealing procedure of the whole waterproof apparatus 2.

Referring to FIGS. 1A, 1B, 2A and 2B, since the above-mentioned waterproof apparatus 1 and 2 of the first and second embodiments can be applied to lamps lighting, and a light-emitting module L, such as a LED module, is disposed on the housing 11 and 21, and at least one electronic element in the air-tight space R is electrically connected to the light-emitting module L. In addition, the housing 11 and 21 can be further covered by a plastic housing, and the plastic housing may include two end caps C, each of which has a circular opening for matching to the shape of the light stand (not shown). Accordingly, the apparatus 1 or 2, the light-emitting module L, the end caps C and the electronic elements can be assembled with the light stand to construct the lighting.

In summary, the waterproof apparatus of this invention achieve the objective of waterproof in three dimensions by using aluminum extruded housing, the first covers and the first waterproof elements, or by using the aluminum extruded housing, the first covers, the first waterproof elements, the second cover and the second waterproof element. Comparing to the conventional device, since the first covers and the first waterproof elements are accommodated in the cavity of the housing, it can not only avoid the sun beam to reduce cracking and breaking of the first waterproof elements, but also make the first waterproof elements more closely connected to the housing. Thus, the tolerance caused by connection of the housing can not influence the waterproof and dust-proof performance, thereby further prolonging the life-span and enhancing the waterproof level of the waterproof structure as well as the electronic products such as the lighting. Besides, the assembling procedure of this invention is simple and easy. The electronic devices can be disposed into the waterproof apparatus in different ways under different conformations. The first embodiment in which the electronic devices are disposed through the first opening can further decrease the waterproof elements and the covers applied in the waterproof apparatus, thereby reducing the production cost.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A waterproof apparatus for outdoor lighting, the waterproof apparatus comprising:
   - a housing manufactured by aluminum extrusion and configured with a cavity, wherein the cavity has two first openings;
   - two first covers, wherein the first covers are accommodated inside the cavity and have a distance to the first openings;
   - an electronic device disposed between the two first covers and accommodated in the cavity of the housing; and
   - two first waterproof elements, wherein each of the first waterproof elements is located at one side of one of the first covers facing to the other first cover.

2. The waterproof apparatus according to claim 1, further comprising a second cover and a second waterproof element, wherein the second cover is disposed on the housing, the second waterproof element is disposed on one side of the second cover opposite to the cavity, and the first covers, the first waterproof elements, the housing, the second cover and the second waterproof element together form an air-tight space to accommodate the electronic device.

3. The waterproof apparatus according to claim 2, wherein the first covers seal two first openings of the cavity, and after the electronic device is disposed into the air-tight space through a second opening of the cavity, the second cover and the second waterproof element seal the second opening.

4. The waterproof apparatus according to claim 3, further comprising a carrier plate, wherein the electronic device is disposed on the carrier plate, and after the carrier plate is accommodated into the air-tight space through one of the first openings, the first covers and the first waterproof elements seal the two first openings of the housing.

5. The waterproof apparatus according to claim 4, wherein the carrier plate is accommodated into the air-tight space and connected to the housing by locking, screwing, adhering or their combinations.

6. The waterproof apparatus according to claim 4, wherein the carrier plate is connected to an inner surface of the housing by gluing.

7. The waterproof apparatus according to claim 4, wherein the carrier plate is locked with long screws from outer surfaces and of the housing after the carrier plate being positioned into the cavity.

8. The waterproof apparatus according to claim 2, wherein the first waterproof element or the second waterproof element has an annular or plate shape.

9. The waterproof apparatus according to claim 2, wherein a concave-convex structure is configured on a portion of the first waterproof element or the second waterproof element contacting with the housing.

10. The waterproof apparatus according to claim 2, wherein the first cover or the second cover is connected to the housing by locking, screwing, adhering, pivoting or their combinations.

11. The waterproof apparatus according to claim 1, wherein each of the first waterproof elements has an annular or plate shape.

12. The waterproof apparatus according to claim 1, wherein a concave-convex structure is configured on a portion of each of the first waterproof elements contacting with the housing.

13. The waterproof apparatus according to claim 1, wherein each of the first covers is connected to the housing by locking, screwing, adhering, pivoting or their combinations.

14. The waterproof apparatus according to claim 1, wherein the housing further comprises a heat dissipation part which is integrally formed with the housing.

15. The waterproof apparatus according to claim 14, wherein heat dissipation part comprises several heat dissipating fins.

16. The waterproof apparatus according to claim 1, wherein the first covers, the first waterproof elements and the housing together form an air-tight space to accommodate the electronic device.

17. The waterproof apparatus according to claim 1, wherein there is one non-solidifying glue applied when the first covers are both accommodated into the cavity so as to not only strengthen waterproof ability but also reinforce anti-vibrate effect.

18. The waterproof apparatus according to claim 1, wherein the waterproof apparatus is applied to lamps.

19. The waterproof apparatus according to claim 1, wherein the waterproof apparatus is collocated with a light-emitting module, and the light-emitting module is disposed on the housing, and at least one electronic element in the air-tight space is electrically connected to the light-emitting module.

20. The waterproof apparatus according to claim 19, wherein the waterproof apparatus is further covered by a plastic housing, and the plastic housing may comprise two end caps, one of which has a circular opening for matching to a shape of a light stand, and therefore the waterproof apparatus, the light-emitting module, the end caps and the electronic element are assembled with the light stand to construct a lamp.

* * * * *